US009165483B2

(12) United States Patent
Cobane

(10) Patent No.: US 9,165,483 B2
(45) Date of Patent: Oct. 20, 2015

(54) APPARATUS FOR DISPLAYING AND ILLUMINATING A FLAG

(71) Applicant: Caleb Lee Cobane, Lexington, KY (US)

(72) Inventor: Caleb Lee Cobane, Lexington, KY (US)

(73) Assignee: Caleb Lee Cobane, Baltimore, MD (US)

( * ) Notice: Subject to any disclaimer, the term of this patent is extended or adjusted under 35 U.S.C. 154(b) by 330 days.

(21) Appl. No.: 13/857,664

(22) Filed: Apr. 5, 2013

(65) Prior Publication Data

US 2014/0301083 A1 Oct. 9, 2014

(51) Int. Cl.

| | |
|---|---|
| ***F21V 33/00*** | (2006.01) |
| ***F21K 99/00*** | (2010.01) |
| ***G09F 13/02*** | (2006.01) |
| ***F21S 8/08*** | (2006.01) |
| ***G09F 17/00*** | (2006.01) |
| *F21Y 101/02* | (2006.01) |
| *G09F 13/22* | (2006.01) |

(52) U.S. Cl.

CPC . *G09F 13/02* (2013.01); *F21S 8/08* (2013.01); *F21V 33/006* (2013.01); *G09F 17/00* (2013.01); *F21Y 2101/02* (2013.01); *G09F 2013/222* (2013.01)

(58) Field of Classification Search

CPC ..... G09F 13/02; G09F 2013/222
USPC ..... 362/253
See application file for complete search history.

(56) References Cited

U.S. PATENT DOCUMENTS

| | | | | |
|---|---|---|---|---|
| 4,519,153 | A | 5/1985 | Moon et al. | |
| 4,590,883 | A | 5/1986 | Steed et al. | |
| 5,305,704 | A | 4/1994 | Olaniyan | |
| 5,463,974 | A | 11/1995 | Seeder | |
| 5,572,835 | A | 11/1996 | Atkins et al. | |
| 6,637,365 | B1 | 10/2003 | Adamski | |
| 6,637,718 | B2 | 10/2003 | Wilson | |
| 6,955,456 | B2 | 10/2005 | Schroeder | |
| 7,017,511 | B2 | 3/2006 | Fisher et al. | |
| 8,215,807 | B1 * | 7/2012 | Brunesti | 362/431 |
| 2004/0083633 | A1 | 5/2004 | Mueller | |
| 2005/0237165 | A1 | 10/2005 | Shimoni | |
| 2007/0035956 | A1 | 2/2007 | Topps | |
| 2007/0089338 | A1 * | 4/2007 | Barnhouse et al. | 40/604 |
| 2008/0104870 | A1 | 5/2008 | Alden | |
| 2010/0263583 | A1 | 10/2010 | Nihra | |
| 2012/0113625 | A1 * | 5/2012 | Werner et al. | 362/183 |

FOREIGN PATENT DOCUMENTS

| | | |
|---|---|---|
| WO | WO9742618 | 11/1997 |

* cited by examiner

*Primary Examiner* — David V Bruce
(74) *Attorney, Agent, or Firm* — Bay Area IP, LLC

(57) ABSTRACT

An apparatus comprises a main pole being configured to be operable to display at least one flag. At least one illumination source is disposed in a longitudinal length of the main pole. The illumination source is configured to at least illuminate a facing surface of the displayed flag. A switch mechanism is configured to be operable for activating and deactivating the illumination source.

18 Claims, 4 Drawing Sheets

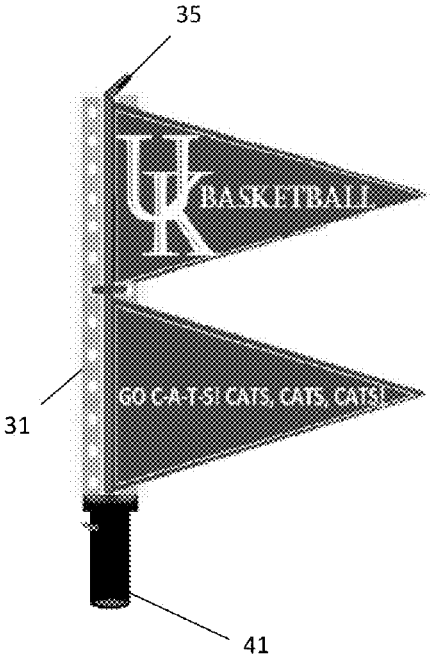
Figure 3A
Figure 3B
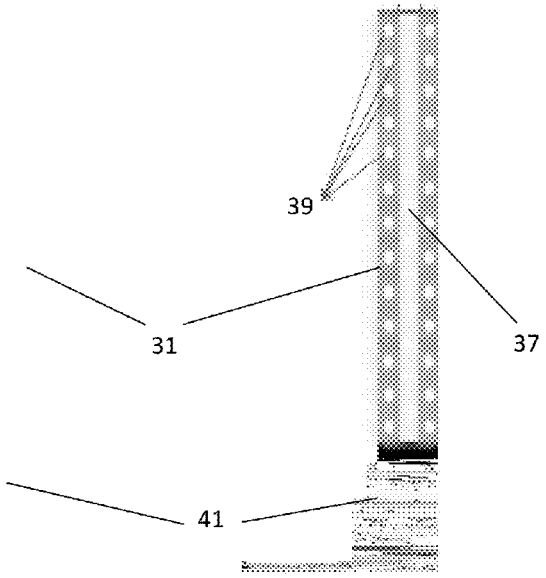
Figure 3C
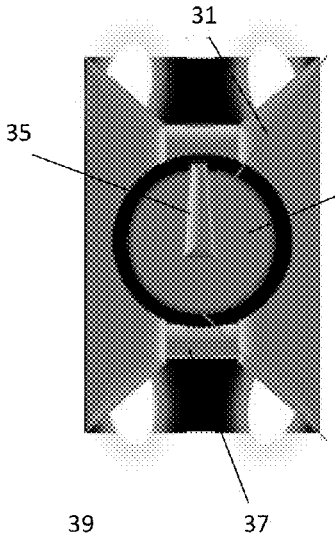
Figure 3D
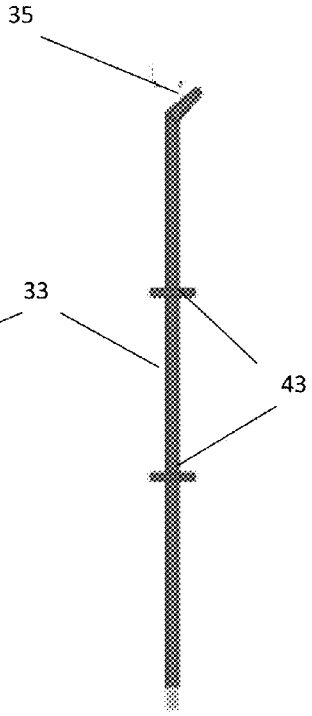
Figure 3E
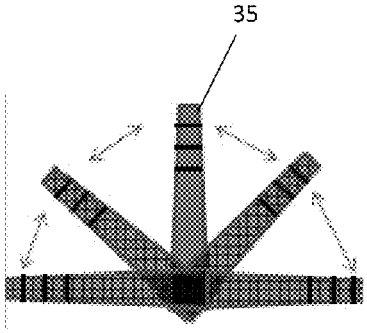
Figure 3F

APPARATUS FOR DISPLAYING AND ILLUMINATING A FLAG

CROSS-REFERENCE TO RELATED APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to flags. More particularly, the invention relates to an interchangeable flag assembly.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that many individuals may wish to display a flag, banner or pennant on their vehicles or other items to show support for an activity, group, or person such as, but not limited to, a sports team, a school, a hobby, a child, a political candidate, etc. Furthermore, some of these individuals may wish to interchange multiple flags of different shapes, sizes, and designs on a single mounting device. In addition, one can expect that it may be desirable for some flags to be lit for improved visibility.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that there are some currently available flag mounting systems that generally provide non-changeable, non-detachable vehicle or non-vehicle flag mounting systems where flags are typically interchanged along with entire pole assemblies so that consumers may need to buy multiple flags with attached pole systems to support multiple groups, people or objects.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic side view of the flagpole system. FIG. 1B is a diagrammatic top view of the flagpole system. FIG. 1C is a diagrammatic side view of an inner pole. FIG. 1D is a diagrammatic front view of the flagpole system. FIG. 1E is a diagrammatic front view of a handle. FIG. 1F is a diagrammatic rear view of the handle, and FIGS. 1G and 1H are diagrammatic front views of the flagpole system with multiple flags attached;

FIG. 2A is a diagrammatic front view. FIG. 2B is a diagrammatic top view. FIG. 2C is a diagrammatic rear view. FIG. 2D is a diagrammatic front view of a flag in place in the vehicle mount. FIG. 2E is a diagrammatic front view of an example of an alternate vehicle mount;

FIGS. 3A through 3F illustrate an exemplary flagpole system, in accordance with an embodiment of the present invention. FIG. 3A is a diagrammatic front view of the system with attached flags. FIG. 3B is a diagrammatic side view of the system. FIG. 3C is a diagrammatic front view of the system. FIG. 3D is a diagrammatic top view of the system. FIG. 3E is a diagrammatic side view of an inner pole, and FIG. 3F is a diagrammatic front view of a securing switch; FIG. 4A is a diagrammatic top view. FIG. 4B is a diagrammatic side view, and FIG. 4C is a diagrammatic front view.

Figure 1A:
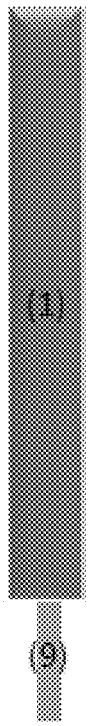
FIGS. 1A through 1H illustrate an exemplary detachable flagpole system with mechanisms to allow for multiple flags of various different shapes and sizes to be displayed on a single pole, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an interchangeable multi-flag mounting device with direct lighting. In some embodiments the mounting device may comprise a detachable flag pole system that may allow for flags of various different designs, colors, shapes and sizes to be interchanged on a single pole via a dual pole design. Some embodiments may comprise multiple light emitting diodes (LEDs) portraying light directly onto an attached flag, banner or pennant. Some embodiments may be attached to various different types of holders such as, but not limited to, vehicle mounts, lighted outdoor mounts, handheld mounts, chair mounts, etc. Various different types of items may be displayed on some embodiments such as, but not limited to, flags, banners, pennants, windsocks, balloons, signs, etc. and are herein referred to simply as flags.

Figure 1B:
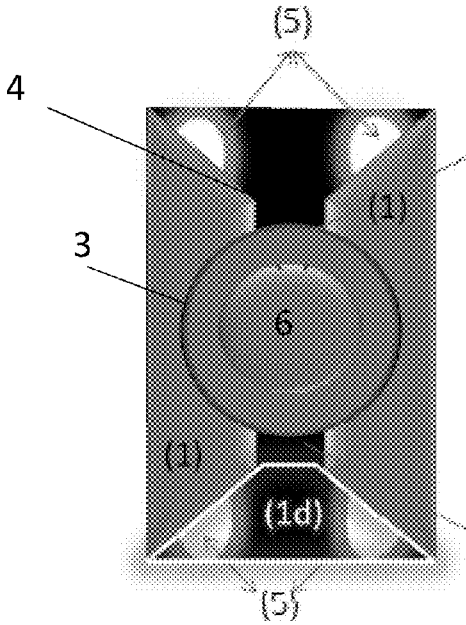
Figure 1C:
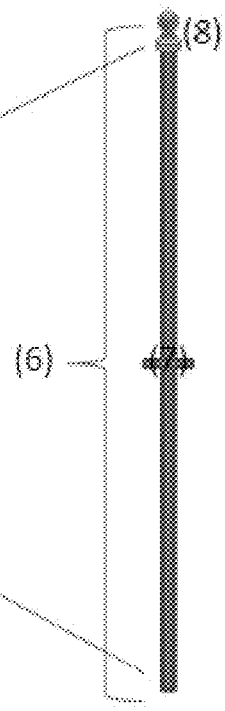
Figure 1D:
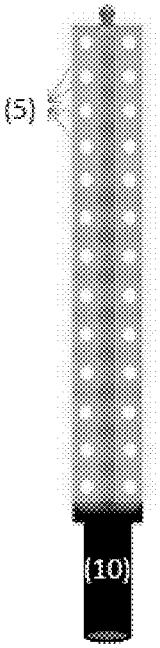
Figure 1E:
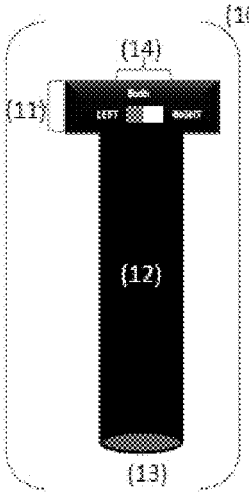

FIGS. 1A through 1H illustrate an exemplary detachable flagpole system with mechanisms to allow for multiple flags of various different shapes and sizes to be displayed on a single pole, in accordance with an embodiment of the present invention. FIG. 1A is a diagrammatic side view of the flagpole system. FIG. 1B is a diagrammatic top view of the flagpole system. FIG. 1C is a diagrammatic side view of an inner pole 6. FIG. 1D is a diagrammatic front view of the flagpole system. FIG. 1E is a diagrammatic front view of a handle 10.

Figure 1F:
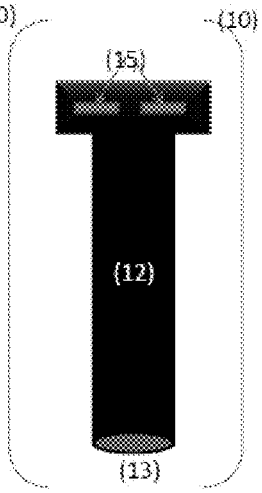
Figure 1G:
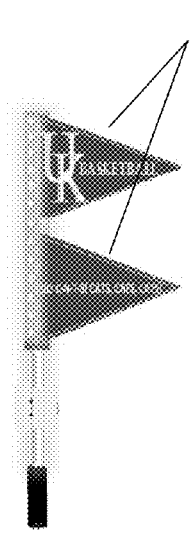
Figure 1H:
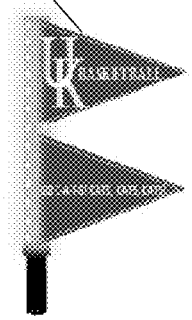

FIG. 1F is a diagrammatic rear view of handle 10, and FIGS. 1G and 1H are diagrammatic front views of the flagpole system with multiple flags 2 attached. The present embodiment comprises a dual pole design which allows for a variety of different flags to be interchanged on a single flagpole assembly and also may allow for the simultaneous use of multiple flags on the single flagpole assembly. The flagpole assembly comprises a main pole 1 and inner pole 6. Referring to FIG. 1B, main pole 1 comprises an inversed twin trapezoidal cross section to create trapezoidal channels 1*d* with a centrally located cylindrical hole 3 which may be used to house inner pole 6. Internal pole 6 may be screwed into or onto main pole 1 at the lower end of hole 3 so that inner pole 6 may be interchangeable to accommodate a variety of different flag sizes. Alternatively, internal pole 6 may be fastened permanently to main pole 1 or may be attached using a multiplicity of suitable means including, without limitation, a pressure fit, hook and loop material, snaps, etc. Additionally, near the inner areas of trapezoidal channels 1*d* are vertical slits 4 that generally allow for ambidextrous use of flags to protrude from slits 4 on either side of main pole 1 for display. The two portions of the main pole may be connected in a variety of means to ensure structural integrity while fulfilling its function of portraying flags, banners, and/or pennants in high winds whilst directing light onto the attached material from the pole. In some embodiments, the two main portions of the main pole may be cast together in a single mold design. In some other embodiments an internal metal pipe or rod, as shown in FIG. 4B, may be formed to fit within the two portions of the main pole for added structural support. In some other embodiments a circular, hollow metal pipe of greater length than the main pole housing the electrical components may be cut vertically for a distance to allow for the flag to pass through while still leaving a portion of the pipe uncut that extends through flag base and handle for added structural support. In still other embodiments numerous smaller poles or other structures can be implemented into the manufacturing process to allow for additional material strengths and rigidity that does or does not need to be secured to the flagpole base using various manufacturing techniques all of which serve the purpose of maintaining the main pole's structural integrity. In some other embodiments the cap 8 shown on FIG. 1*c* may be used not only to secure flags, banners and/or pennants to the internal pole but may be sized to add structural integrity to the main pole by connecting and securing the tops of the two main pole portions together similar to a lid function by changing the size and shape of the cap to a square shape that can be sized to be snapped on the top of the main pole to lock the two main pole portions in place while still performing the same function of a cap to the inner pole 6. The body of inner pole 6 is of a smaller diameter than hole 3 of main pole 1 yet is larger in diameter than the width of slits 4 of main pole 1. This may generally prevent inner pole 6 from passing through slits 4, thus locking inner pole 6 within main pole 1. In this manner, a flag could be made with a pole-hem at one end that may be fashioned to slide onto inner pole 6 from the top. Those skilled in the art will readily recognize, in light of and in accordance with the teachings of the present invention, that the main pole and inner pole in some alternate embodiments may be implemented in a multiplicity of suitable shapes. For example, without limitation, in one embodiment, the inner pole may be a square tube and the main pole may comprise a square hole into which the inner pole may be inserted. In another embodiment, the main pole may comprise more or fewer vertical sections for example, without limitation, four sections with one on each corner or one section with a single slit. Moreover, in some embodiments, flags may be secured to the poles using various different means such as, but not limited to, clips, snaps, clamps, or other fasteners rather than being secured around an internal pole.

Referring to FIG. 1C, in the present embodiment, inner pole 6 comprises a spacer 7 which may be a circular disc that is strategically placed on inner pole 6. Spacer 7 is typically larger in diameter than inner pole 6 and therefor larger than the width of slits 4 yet smaller in diameter than cylindrical hole 3 of main pole 1. Since inner pole 6 and spacer 7 are typically large enough to not pass through slits 4 created by the trapezoidal shape the material of the flag around inner pole 6 is held in place while the remaining portion of the flag may extend from a slit 4 for display. Additionally, spacer 7 may allow for multiple flags to fly on inner pole 6 at any given time by isolating flags within the separate areas of inner pole 6 typically created by spacer 7. For example, without limitation, in the present embodiment one flag may be isolated on the lower portion of inner pole 6 below spacer 7, and another flag may be isolated on the upper portion of inner pole 6 above spacer 7. In some embodiments multiple spacers may be placed on the inner pole, as illustrated by way of example in FIG. 3E. Furthermore, the flag spacers in some alternate embodiments may take various different fashions, shapes and forms such as, but not limited to, rectangular or spherical spacers and may be permanently fixed to the internal pole or removable. Other embodiments may be implemented without spacers or with a multiplicity of suitable alternate means for securing a flag within the main pole such as, but not limited to, clips, snaps, hook and loop material, a sticky coating on the inner pole, etc. In the present embodiment, a cap 8 may be used to further secure the flag within main pole 1 and to generally prevent the flag from sliding off the top of inner pole 6. Cap 8 fits snugly within cylindrical hole 3 of main pole 1 and is secured to the top of inner pole 6. It is contemplated that in some embodiments the cap may be secured onto the inner pole or main pole with a threaded connection or a hinged connection. It is further contemplated that some embodiments may be implemented with no means for securing the top of the inner pole or various different means for securing the top of the inner pole such as, but not limited to, a cap over the entire top of the pole assembly, a movable switch, a fabric flap, etc.

Referring to FIG. 1A, in the present embodiment, the flagpole assembly comprises an internal metal rod 9 that runs the length of main pole 1 and inner pole 6 and protrudes from the lower end of the flagpole assembly to aid in maintaining the structural integrity of the flagpole assembly in high winds. Some embodiments may implement any number of structural enhancements to generally ensure structural integrity and minimize damage from strong winds including, without limitation, metal rods of various different lengths, internal rods made of various different materials such as, but not limited to, wood or plastic, a flexible base to absorb some force from wind, etc. In addition, the tops of the poles may be joined together in various fashions or strategic connections between the two sides of the main pole may be made for added structural strength. The end cap 8 on the inner pole 6 is screw on or screw off from the inner pole 6. Thus allowing the user to simple remove the end cap 8 and slide the desired flag onto the inner pole 6 and over the spacer 7, if desired. For smaller sized flags, banners or pennants the force of the wind may lock the flag to the inner pole 6 while not allowing it to pass over the spacer 7. For larger flags, the entire flag may go over the length of the inner pole 6 as well as the spacer 7 with the wind serving as a locking mechanism and the end cap 8 to prevent it from flying off the top of the inner pole 6. It is contemplated that in some embodiments, no structural reinforcement may be needed with utilization of sufficiently strong materials in the flagpole assembly itself.

Referring to FIG. 1B, light sources 5 are typically placed within trapezoidal channels 1*d* of main pole 1 and may project light onto the surface area of any displayed flags at an angle to direct the large majority of lighting directly onto the flag surface and out the length of the flag while typically not portraying light directly into traffic at all angles thus making the flag highly visible while generally minimizing distraction to drivers. In addition, the dual sided nature of the placement of light sources 5 may allow for illumination of the displayed flags on both sides and allow for ambidextrous placement of the flagpole system on either side of a vehicle. In some alternate embodiments the trapezoidal shapes of the main pole may be replaced with various different shapes to perform a similar function of portraying light onto the surface area of the displayed flag such as, but not limited to, semi-circular shapes or triangular shapes. It is contemplated that the LED's in some embodiments may be attached in various different fashions or manners to portray light directly onto the main surface of the flag from the pole housing such as, but not limited to, internal placement of the lights within the main pole housing to portray out onto the flag, banner and/or pennant from within the main pole housing with or without use of a lens or focusing element, or placement of the light source that protrudes through the main pole housing with the light source exposed as shown in FIG. 1B, or the lights may be attached to the main pole 1 housing to protrude out from the main pole to increase the angle of which the lights portray light onto the surface of the attached flag, banner and or pennant. In some embodiments, the flags rather than the poles may be illuminated through various means such as, but not limited to, implementing a lead connector like apparatus on the main pole 1 or inner pole 6 that connects a flag with built in lighting elements to use the current conducted through the main pole 1 or inner pole 6 to supply electricity needed to allow the lights in the flag to be illuminated. Those skilled in the art will readily recognize, in light of and in accordance with the teachings of the present invention, that a multiplicity of suitable lighting sources may be used in some embodiments such as, but not limited to, incandescent lighting, fluorescent lighting, or no lighting source.

In the present embodiment, a handle 10 may be attached to the lower portion of main pole 1. Referring to FIGS. 1E and 1F, a main body 12 of handle 10 may enable a user to easily grasp the entire flagpole assembly to allow for complete mobility and control by the user. A direction switch 14 on handle 10 may control whether the right side, left side or both sides of light sources 5 are powered to match the needs of the user and their desired flag configuration. The power is controlled by an on/off switch 13 located in handle 10 as is the placement of the power source. In some embodiments the exact placement of the electrical components including, without limitation, wiring, lights, switches, power supply housing, on/off buttons, etc. may be placed in various different locations on handle 10 or the flagpole assembly. For example, without limitation, the light source controls may be inaccessible during mounting to generally prevent accidental activation of the power. Other embodiments may be implemented that use a vehicle power supplies, residential power supplies or commercial power supplies to power the light sources. In the present embodiment, referring to FIGS. 1G and 1H, handle 10 may be extendable for increased pole length and may be internally lit when light sources 5 are powered on. FIG. 1G shows handle 10 in an extended position, and FIG. 1H shows handle 10 in a contracted position. It is contemplated that handles in some embodiments may not be extendable or lighted. Handle 10 may further comprise security mechanisms 15 to typically allow for secure placement of the flagpole assembly into a mount, as illustrated by way of example in FIG. 2D. In the present embodiment, security mechanisms 15 are tabs that fit into slots or holes in the mount. Some embodiments may be implemented with various different locking means such as, but not limited to, screws or clamps or no locking mechanisms.

Figures 2A, 2B, 2C:
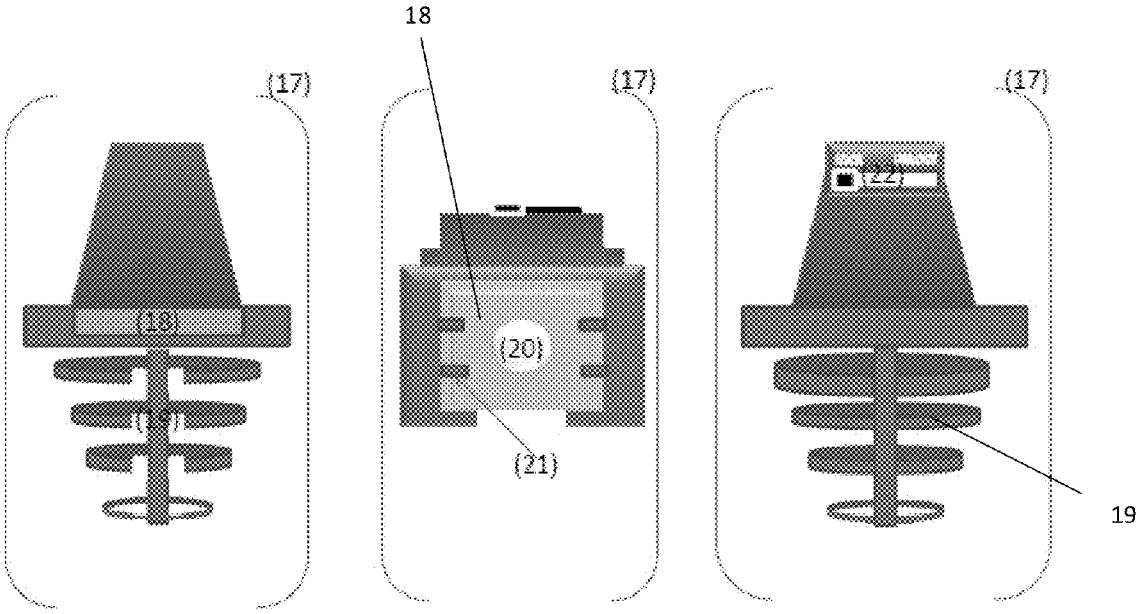
FIGS. 2A through 2E illustrate an exemplary vehicle mount for a flagpole system, in accordance with an embodiment of the present invention.
Figure 2D:
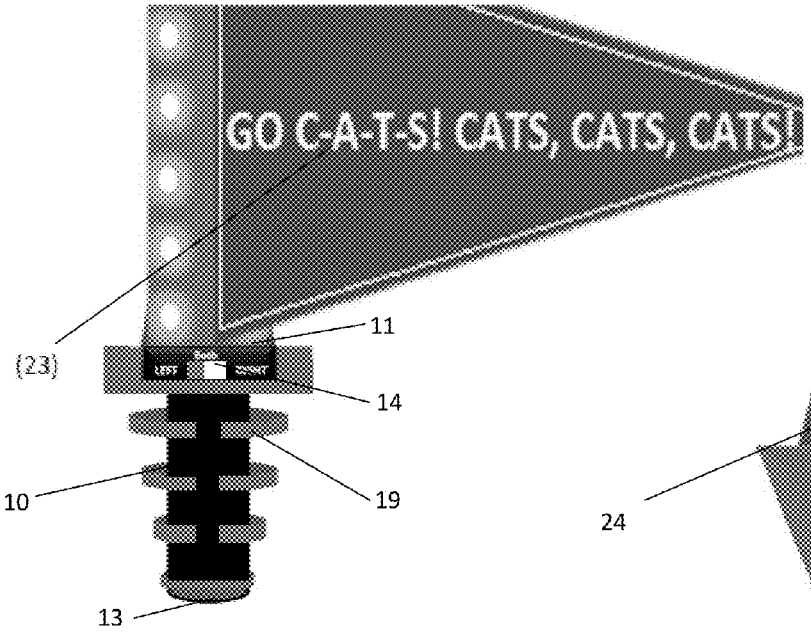
Figure 2E:
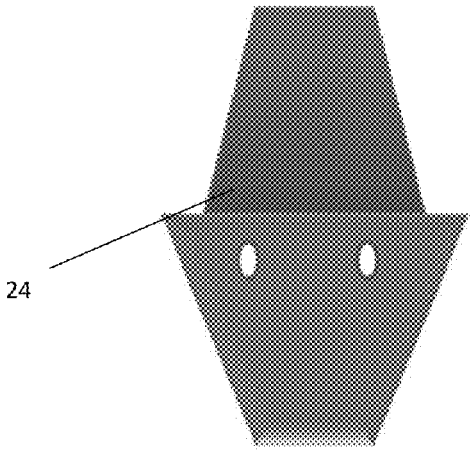

FIGS. 2A through 2E illustrate an exemplary vehicle mount 17 for a flagpole system, in accordance with an embodiment of the present invention. FIG. 2A is a diagrammatic front view. FIG. 2B is a diagrammatic top view. FIG. 2C is a diagrammatic rear view. FIG. 2D is a diagrammatic front view of a flag 23 in place in vehicle mount 17. FIG. 2E is a diagrammatic front view of an example of an alternate vehicle mount 24. In the present embodiment, a base 11 of handle 10 fits snugly into a recess 18 in vehicle mount 17 to allow for the main body of the handle 10 to protrude through a hole 20 in recess 18. Handle 10 may be further secured by supports 19, unlocking/locking devices 22, or via any variety of other methods such as, but not limited to, a mechanical or electromechanical lock that may be operated by turning some form of removable key, by keying or dialing in a combination that directly or via electromechanical means operates the lock, with some form of magnetic or card reader, or by moving a part on a safety lock intended to prevent accidental operation and or unauthorized access. Element 21 in FIG. 2B and Element 22 in FIG. 2C are representative of the above mentioned locking mechanisms that may be implemented into the design which any method chosen will meet the desired need of preventing accidental operation or unauthorized access to the flagpole or flags, banners and or pennants that are being flown. These locking mechanisms may be implemented on the flagpole, flag mount or both. In some embodiments the mounts may be implemented with no securing means. Referring to FIG. 2D, in the present embodiment, while mounted a light source directional switch 14 and an on/off switch 13 on handle 10 are accessible. The entire flagpole assembly is typically easily detachable from vehicle mount 17 so that the flagpole assembly may be mobile for use in a sporting arena or anywhere away from vehicle mount 17. It is contemplated that the flagpole assembly may be secured to a mount in various different fashions other than by the handle base as illustrated by way of example in the present embodiment for example, without limitation, a hook on the main pole, grommet style loops on the main pole for attachment to a lanyard style conventional flagpole that may be hooked onto or connected via rope or other means to be secured for viewing, ect. Furthermore, various different vehicular mounts or non-vehicular mounts could be used in some embodiments to secure the flag assembly to objects such as but not limited to vehicle mount 24 shown by way of example in FIG. 2E, chair mounts, table mounts, house mounts, etc.

Referring to FIGS. 1A through 1H, in typical use of the present embodiment, a user removes cap 8 from the top of inner pole 6 and places the pole hem of a flag or flags 2 over inner pole 6 so that flag 2 protrudes out of a slit 4. Then, the user replaces cap 8. The user may then carry the flag assembly or place the assembly in a mount for display. If desired the user may illuminate flag 2 by turning on a power switch 13 and may control which side or sides of main pole 1 are lit up with direction switch 14. The user may also extend handle 10 if desired. Flags may be easily interchanged on the flagpole assembly by removing cap 8 and the current flags and placing new flags on inner pole 8. The present embodiment may be used in practically any weather condition including, without limitation, high winds and may operate equally as well in both outdoor and indoor environments. The present embodiment may be mounted on various different objects such as, but not limited to, automobiles, ATV's, golf carts, boats, walls, tables, chairs, etc.

The present embodiment may provide users with the ability to purchase a single pole unit for all of their sports and personal flag wishes rather than purchasing an entire flag pole with every flag for their various sports teams activities, etc. Additionally, the present embodiment may enable a user to display multiple flags of various different sizes and shapes on a single pole. This may incorporate greater variety and customization for the user and ultimately cost savings. The dual LED design of the present embodiment may enable the pole assembly to be used on either side of a vehicle with use of selector switch 14 to light the side of the pole on which the flag or flags are placed whether it be right, left or both sides simultaneously. The internal power supply may also allow the entire apparatus to be hand-used with and fully mobile when separated from a mounting apparatus.

FIGS. 3A through 3F illustrate an exemplary flagpole system, in accordance with an embodiment of the present invention. FIG. 3A is a diagrammatic front view of the system with attached flags 2. FIG. 3B is a diagrammatic side view of the system. FIG. 3C is a diagrammatic front view of an external pole 31. FIG. 3D is a diagrammatic top view of the system. FIG. 3E is a diagrammatic side view of an inner pole 33, and FIG. 3F is a diagrammatic front view of a securing switch 35. In the present embodiment, the flagpole system comprises external pole 31 and internal pole 33 design. External pole 31 is larger in diameter than internal pole 33 so as to surround internal pole 33 and comprises lateral slits 37 from witch flags 2 may protrude. External pole 31 may also comprise added material to provide additional structural support. Electronic components including without limitation, a power source and control switches for lighting sources 39 may be housed in external pole 31 for in a handle 41. Referring to FIG. 3E, inner pole 33 may comprise one or more spacers 43 to typically enable multiple flags or a single flag to be placed on inner pole 35. Some embodiments may be implemented with no spacers. In the present embodiment, flags 2 may be secured on inner pole 33 with securing switch 35 at the top of inner pole 33. Referring to FIG. 3F, when flipped to 90 degrees, securing switch 35 is aligned with inner pole 33 to typically allows for easy removal or placement of flags 2 onto inner pole 33, and when securing switch 35 is in place at 0 degrees or 180 degrees, switch 35 blocks flags 2 from sliding off the top of inner pole 33. It is contemplated that some embodiments may comprise various different flag securing means or no securing means on top of inner pole 33. In the present embodiment, the entire flagpole assembly may be secured to a vehicular or non-vehicular mount or may be used in a hand-held manner.

Figure 4A:
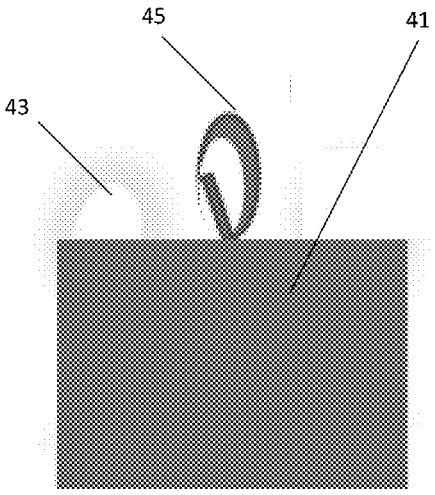
FIGS. 4A through 4C illustrate an exemplary flagpole system, in accordance with an embodiment of the present invention.
Figure 4B:
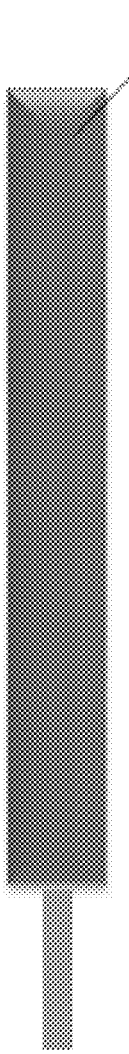
Figure 4C:
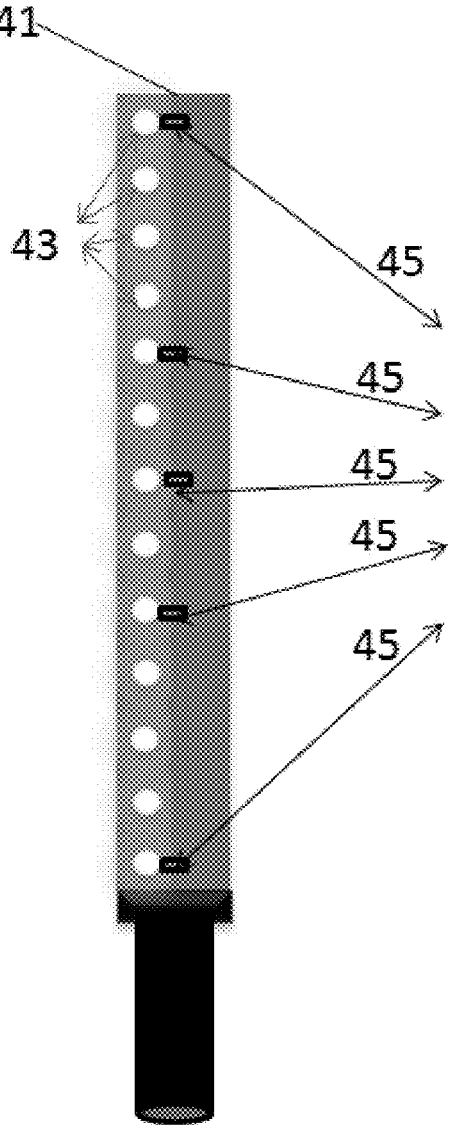

FIGS. 4A through 4C illustrate an exemplary flagpole system, in accordance with an embodiment of the present invention. FIG. 4A is a diagrammatic top view. FIG. 4B is a diagrammatic side view, and FIG. 4C is a diagrammatic front view. In the present embodiment, the system comprises a single or main pole 41 that houses light sources 43 to portray light directly onto a flag attached to pole 41. Pole 41 comprises two or more flag clips 45 to secure a flag or flags to main pole 41. To be attached to pole 41 a flag may require strategically placed metal grommets or other attachment means such as, but not limited to, holes, loops, hooks, clips, etc. In some embodiments, the number of clips may be changed along with the size and dimensions of the pole and accompanying components. Some alternate embodiments may comprise various different attachment means such as, but not limited to, snaps, tabs, hook and loop material, etc. In similar fashion, the flag clips on the pole in some embodiments may take various different shapes and forms and may be permanently fixed to the pole or removable. In the present embodiment, an on/off switch to control light sources 43 may be included without limitation, on a handle 47 or on pole 41. Some embodiments may be implemented without lighting and would therefore not require an on/off switch or other electronic components. In typical use of the present embodiment, a flag is attached to clips 45 and may be illuminated by light sources 43. Alternately, a flag may be placed over the entire pole 41 rather than being clipped on so that lighting sources 43 may shine through the fabric of the flag.

Those skilled in the art will readily recognize, in light of and in accordance with the teachings of the present invention, that embodiments with a single pole and attachment means may be implemented in a multiplicity of suitable shapes. For example, without limitation, one embodiment may comprise a single pole with trapezoidal shapes, as illustrated by way of example in FIG. 1B, with multiple clips placed optimally in the valley of the trapezoidal shape on both sides for attaching the base of a flag between light sources on the pole while also allowing the point of contact of the flag to the main pole to be closer to the inner part of the main pole than the light sources and therefore typically allowing the light to portray out onto the flag. However, light sources do not need to protrude past the attached flag clips to perform the function of portraying light directly onto the flag. This pole may or may not comprise a cylindrical hole. Some embodiments may comprise a dual pole system with a main pole and an inner pole and external attachment means together. For example, without limitation, one such embodiment may comprise a main pole with a single slit on one side and external attachment means on the opposite side. This may enable a flag to be placed on inner pole to protrude from the slit and/or another flag to be attached to the external attachment means. Another such embodiment may comprise two slits on opposing sides and external attachment means on the other two sides.

In some embodiments, the main pole may comprise a cylindrical hole without an inner pole. Specially designed flags may be fitted with a pole of plastic, metal, or other rigid materials at the base that may enable the flags to be slid into the cylindrical hole of the main pole from the top. The poles attached to the flag bases may be larger in diameter than the vertical slit or slits in the main pole and thus could typically not pass through. A single large pole could be placed in larger flags and the same diameter yet shorter poles could be placed in smaller flags to allow multiple flags to be dropped in from the top on top of one another. A top locking device such as, but not limited to a cap or a switch may be placed at the top of the main pole to help to keep the flags secure.

In some embodiments an interchangeable flag assembly can be sold in a bundle with various flags of different shapes and sizes. Additionally, some embodiments may be sold with various different mounting apparatuses such as, but not limited to, a vehicle mounting kit as described in the foregoing or with an extension pole for additional height. A home kit can also be made in some embodiments by bundling a flag pole assembly with various wall mounts to allow flags to be displayed in a residential or commercial capacity for inside or outside use. Likewise, various flags can be bundled and sold in a package coordinating with any major holiday such as, but not limited to, Christmas. Some embodiments may be sold in a promotional capacity with various sporting equipment and or memorabilia. Additionally, some embodiments may be sold in addition to various handles and grips for multiple different uses. In some embodiments, a single party could manufacture the lighted flag pole assembly while another company could develop and or manufacture the method of attaching a flag. Some embodiments may be implemented as a separate detachable light source that may attach to a typical vehicle flags that is battery powered and portrays light out onto the surface of the displayed flag. Some embodiments may include a non-removable flagpole from the vehicle mount and instead the vehicle mount and the pole could be made of a single mold.

Those skilled in the art will readily recognize, in light of and in accordance with the teachings of the present invention, that some embodiments may be implemented with a multiplicity of suitable styles and designs such as, but not limited to, flags of various different shapes or licensed designs from groups such as, but not limited to, the National Football League, the National Basketball Association, Men's League Soccer, any other professional sports league, universities and higher education facilities throughout the nation, etc. Some embodiments may enable users to create personalized flags. For example, without limitation, to promote a company or product, for families for recreational and/or patriotic use, for religious organizations, various charities and causes, etc. Other embodiments may comprise various different features such as, but not limited to, mechanisms that enable the flag to wave or rotate, flashing or colored lights to coordinate with the flags, speakers for playing music or other noises, etc.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing an interchangeable flagpole assembly according to the present invention will be apparent to those skilled in the art. Various aspects of the invention have been described above by way of illustration, and the specific embodiments disclosed are not intended to limit the invention to the particular forms disclosed. The particular implementation of the interchangeable flagpole assembly may vary depending upon the particular context or application. By way of example, and not limitation, the interchangeable flagpole assemblies described in the foregoing were principally directed to illuminated implementations; however, similar techniques may instead be applied to non-illuminated flagpole assemblies, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising:

a main pole being configured to be operable to display at least one flag;

at least one illumination source being disposed in a longitudinal length of said main pole, said illumination source being configured to at least illuminate a facing surface of the displayed flag an inner pole being configured to be disposed longitudinally within said main pole, said inner pole being further configured to be operable to removably retain a longitudinal side of the flag in which at least a remaining portion of the flag is displayed outside said main pole.

2. The apparatus as recited in claim 1, in which said inner pole is further configured to be slidable within a pole-hem of the flag.

3. The apparatus as recited in claim 2, further comprising a member being configured to join to a top end of said inner pole for mitigating slippage of the flag off said top end.

4. The apparatus as recited in claim 2, further comprising at least one spacer being joinable to said inner pole to separate the flag from an addition flag placed on said inner pole.

5. The apparatus as recited in claim 1, further comprising a handle being joined to a bottom portion of said main pole to enable mobility and control by a user.

6. The apparatus as recited in claim 5, further comprising a switch mechanism being configured to be operable for activating and deactivating said illumination source, said switch mechanism being disposed within said handle.

7. The apparatus as recited in claim 1, in which said main pole further comprises an inversed twin trapezoidal cross section comprising two longitudinal trapezoidal channels each comprising a vertical slit being configured to be operable to pass the flag to be displayed, and a centrally located cylindrical hole being configured to house said inner pole.

8. The apparatus as recited in claim 7, in which said at least one illumination source is disposed on a first side and a second side of a first of said two longitudinal trapezoidal channels in which said illumination source is operable to illuminate both sides of the flag passing through said vertical slit of said first longitudinal trapezoidal channel.

9. The apparatus as recited in claim 8, further comprising an additional illumination source being disposed on a first side and a second side of a second of said two longitudinal trapezoidal channels in which said illumination source is operable to illuminate both sides of the flag passing through said vertical slit of said second longitudinal trapezoidal channel.

10. The apparatus as recited in claim 9, further comprising a selection switch mechanism being dispose on a handle, said handle being joined to a bottom portion of said main pole, said selection switch mechanism being configured to be operable for selectively activating and deactivating combinations of said illumination source and said additional illumination source.

11. The apparatus as recited in claim 5, in which said handle further comprises security mechanisms to enable secure placement of the apparatus into at least one of a vehicle mount, wall mount, table mount, and chair mount.

12. The apparatus as recited in claim 1, further comprising a handle being joined to a bottom portion of said main pole being configured to enable mobility and control by a user, in which said handle comprises a security mechanism configured to enable secure placement of the apparatus into at least one of a vehicle mount, wall mount, table mount, and chair mount.

13. The apparatus as recited in claim 9, in which said illumination source and said additional illumination source comprise LED lights.

14. An apparatus comprising:

means being configured to be operable for displaying at least one flag;

means for illuminating surfaces of the flag, said means being disposed in a longitudinal length of said displaying means;

means being configured to be operable for activating and deactivating said illuminating means;

means being configured to be disposed longitudinally within said displaying means for removably retaining a longitudinal side of the flag in which at least a remaining portion of the flag is displayed outside said displaying.

15. The apparatus as recited in claim 14, further comprising means being configured to join to a top end of said retaining means for mitigating slippage of the flag off said top end.

16. The apparatus as recited in claim 14, further comprising means being joinable to said retaining means for separating the flag from an addition flag placed on said retaining means.

17. The apparatus as recited in claim 14, further comprising means for enabling mobility and control by a user disposed on a proximate bottom portion of said displaying means, in which said means for activating and deactivating said illuminating means is disposed to a proximate top portion of said mobility and control enabling means.

18. An apparatus comprising:

a main pole being configured to be operable to display at least one flag, said main pole comprising an inversed twin trapezoidal cross section comprising two longitudinal trapezoidal channels each comprising a vertical slit being configured to be operable to pass the flag to be displayed, and a centrally located cylindrical hole;

an inner pole being configured to be disposed longitudinally within said cylindrical hole, said inner pole being further configured to be slidable within a pole-hem of the flag to removably retain a longitudinal side of the flag in which at least a remaining portion of the flag is displayed outside said main pole;

a member being configured to join to a top end of said inner pole for mitigating slippage of the flag off said top end;

at least one spacer being joinable to said inner pole to separate the flag from an addition flag placed on said inner pole;

a first LED illumination source being disposed on a first side and a second side of a first of said two longitudinal trapezoidal channels in which said first LED illumination source is operable to illuminate both sides of the flag passing through said vertical slit of said first longitudinal trapezoidal channel;

a second LED illumination source being disposed on a first side and a second side of a second of said two longitudinal trapezoidal channels in which said second LED illumination source is operable to illuminate both sides of the flag passing through said vertical slit of said second longitudinal trapezoidal channel;

a handle being joined to a bottom portion of said main pole to enable mobility and control by a user, said handle comprising security mechanisms for enabling secure placement of the apparatus into a mount;

a switch mechanism being disposed within said handle, said switch mechanism being configured to be operable for activating and deactivating said illumination source; and a selection switch mechanism being dispose on said handle, said selection switch mechanism being configured to be operable for selectively activating and deactivating combinations of said first LED illumination source and said second LED illumination source.

* * * * *